US008162435B2

(12) United States Patent
Kubo et al.

(10) Patent No.: US 8,162,435 B2
(45) Date of Patent: Apr. 24, 2012

(54) LIQUID DROPLET JETTING APPARATUS

(75) Inventors: Tomoyuki Kubo, Nagoya (JP); Takaichiro Umeda, Nagoya (JP); Ryuji Kato, Aisai (JP); Hisaki Sakurai, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 574 days.

(21) Appl. No.: 12/324,417

(22) Filed: Nov. 26, 2008

(65) Prior Publication Data

US 2009/0141074 A1 Jun. 4, 2009

(30) Foreign Application Priority Data

Nov. 30, 2007 (JP) ..... 2007-309962

(51) Int. Cl.
*B41J 2/165* (2006.01)
*B41J 2/175* (2006.01)

(52) U.S. Cl. ..... 347/30; 347/85

(58) Field of Classification Search ..... 347/85
See application file for complete search history.

(56) References Cited

U.S. PATENT DOCUMENTS 6,126,263 A * 10/2000 Hotomi et al. ..... 347/15
6,203,148 B1 3/2001 Kishida
6,312,094 B1 11/2001 Ito et al.
6,982,737 B2 * 1/2006 Elko et al. ..... 347/171
7,273,272 B2 9/2007 Inoue
7,780,261 B2 * 8/2010 Berry et al. ..... 347/29
2005/0078155 A1 4/2005 Campion et al.
2006/0197818 A1 * 9/2006 Takatsuka ..... 347/104
2007/0285474 A1 * 12/2007 Murakami ..... 347/85

FOREIGN PATENT DOCUMENTS

JP 10-095129 4/1998
JP 10244681 9/1998
JP 11091130 4/1999
JP 2002/331687 11/2002
JP 2005/088548 4/2005
JP 2005-306016 11/2005
JP 2006/312291 11/2006
JP 2007/021909 2/2007
JP 2007/508168 4/2007
JP 2007/203641 8/2007

* cited by examiner

*Primary Examiner* — Stephen Meier
*Assistant Examiner* — Tracey McMillion
(74) *Attorney, Agent, or Firm* — Frommer Lawrence & Haug LLP

(57) ABSTRACT

A printer comprises a first head which has first nozzles, a second head which has second nozzles each having a nozzle diameter larger than that of the first nozzle, and an ink cartridge which stores an ink to be supplied to the first and second heads. The first head is directly connected to the ink cartridge by means of a tube. The second head is connected to the first head by means of a tube, and thus the second head is connected to the ink cartridge via the first head. Accordingly, it is possible to shorten the tubes by connecting the ink cartridge and the two heads in series. Further, it is possible to decrease the frequency of the recovery operation by arranging, on the downstream side in the liquid supply direction, the head in which the jetting failure is hardly caused.

9 Claims, 11 Drawing Sheets

LIQUID DROPLET JETTING APPARATUS

CROSS REFERENCE TO RELATED APPLICATION

The present application claims priority from Japanese Patent Application No. 2007-309962, filed on Nov. 30, 2007, the disclosure of which is incorporated herein by reference in its entirety.

BACKGROUND OF THE INVENTION

1. Field of the Invention

The present invention relates to a liquid droplet jetting apparatus which jets liquid droplets.

2. Description of the Related Art

In general, an ink-jet printer, which records images, letters and the like on a recording medium such as the printing paper, includes an ink-jet head (liquid droplet-jetting head) which has nozzles for jetting liquid droplets of the ink, and an ink cartridge (liquid storage container, ink tank) for storing the ink to be used for the ink-jet head. Usually, the ink-jet head and the ink cartridge are connected to one another by means of a tube made of resin. The ink, which is stored in the ink cartridge, is supplied to the ink-jet head via the tube.

In recent years, it is investigated that a plurality of ink-jet heads, which jet an ink of the same type (same color), are provided in one printer, for example, in order to improve the recording speed. When a plurality of ink cartridges are provided in the printer corresponding to the plurality of ink-jet heads respectively, then the number of the ink cartridges is increased, the cost is increased, and the printer is large-sized. Therefore, it is preferable that the ink can be simultaneously supplied from one ink cartridge to the plurality of ink-jet heads.

Japanese Patent Application Laid-open No. 10-95129 discloses an ink cartridge provided with two ink supply ports. The two ink supply ports of the ink cartridge are connected in parallel to two ink-jet heads by means of two supply-tubes (tubes). Therefore, it is possible to supply the ink of the same color to the two ink-jet heads respectively.

When one ink cartridge is connected to two ink-jet heads individually (in parallel) by means of a plurality of tubes, the total length of the tubes is consequently long as compared with a case in which one ink cartridge and two ink-jet heads are connected in series, which results in the increase in the cost. When the tubes are made of resin, and the tubes have the gas permeability to some extent, then the following problem may arise. That is, the ink contained in the tubes is dried little by little, and the viscosity is increased, and/or the bubbles make invasion into the tubes from the outside. In such a situation, the longer the total length of the tubes is, the larger the amount of the ink subjected to the increase in viscosity in the tubes is, and/or the larger the amount of bubbles to make invasion into the tubes is. If the viscosity-increased ink and/or the ink containing a large amount of bubbles is/are supplied to the ink-jet head, the jetting failure arises in the nozzle with ease. In view of the above, the present inventors have investigated that one ink cartridge and two ink-jet heads are connected in series in order to shorten the total length of the tubes.

However, when one ink cartridge and two ink-jet heads are connected in series, the length of the tubes, through which the ink pass until arrival at the most downstream head positioned at the most downstream side in the ink supply direction, is increased depending on the distance from the ink cartridge to the most downstream head. Therefore, the viscosity-increased ink and/or the ink containing a large amount of bubbles is/are supplied to the head which is disposed far from the ink cartridge. Therefore, the jetting failure tends to arise in the nozzles of the head which is separated far from the ink cartridge. It is necessary to frequently perform the recovery or restoring operation for recovering the jetting performance in order to remove the viscosity-increased ink, the bubbles, or the like, the recovery operation including the purge operation for forcibly discharging the ink from the nozzles.

SUMMARY OF THE INVENTION

An object of the present invention is to provide a liquid droplet jetting apparatus which makes it possible to shorten the length of tubes by connecting a liquid storage container and two liquid droplet-jetting heads in series and which makes it possible to decrease the frequency of the recovery operation by arranging the head in which the jetting failure hardly occurs, on the downstream side in the liquid supply direction.

According to an aspect of the present invention, there is provided a liquid droplet jetting apparatus which jets a droplet of a liquid onto an object, the liquid droplet jetting apparatus including:

a first head in which first nozzles are formed;

a second head in which second nozzles are formed, each of the second nozzles having a nozzle diameter greater than that of one of the first nozzles;

a liquid tank which stores the liquid to be supplied to the first head and the second head; and a plurality of tubes which connect the first head, the second head, and the liquid storage container respectively, wherein the first head is connected to one end of one tube of the tubes and the liquid tank is connected to the other end of the one tube; and the second head is connected to the first head by another tube of the tubes, and the second head is connected to the liquid tank via the first head.

According to the present invention, the second head is connected to the liquid tank via the first head. In other words, the liquid tank and the first and second heads are connected in series. Therefore, it is possible to shorten the total length of the tubes as compared with a case in which the liquid tank and the two heads are connected by means of two tubes respectively (in parallel). Therefore, it is possible to reduce the cost required for the tubes. Further, it is also possible to suppress the increase in viscosity of the liquid in the tubes and the invasion of air bubbles into the tubes.

When the nozzle diameter differs between the two heads, the head (first head), which has the small nozzle diameter, tends to cause the jetting failure including, for example, the nozzle clog-up and the non-straight jetting (jetting curvature) or bending due to the influence of the viscosity-increased liquid and the mixed bubbles as compared with the head (second head) which has the large nozzle diameter. In view of the above, when the two heads are arranged in series, the second head, which has the large nozzle diameter and which hardly causes the jetting failure, is arranged on the downstream side in the liquid supply direction separated away from the liquid tank. Accordingly, it is possible to suppress the occurrence of the jetting failure in the first head. It is possible to decrease the frequency of the recovery operation such as the purge for recovering the jetting performance.

In the liquid droplet jetting apparatus of the present invention, the first head may be capable of jetting the droplet of the liquid at a volume smaller than that of the droplet jetted by the second head.

The smaller the volumes of the liquid droplets jetted from the nozzles are, the larger the influence exerted by the viscosity-increased liquid and the bubbles is, wherein any inconvenience such as the non-straight jetting tends to occur. However, according to the present invention, the second head, which jets the liquid droplets having the large volumes, is arranged on the downstream side in the liquid supply direction to which the viscosity-increased liquid and the liquid containing a large amount of air bubbles are supplied. Therefore, it is possible to suppress the occurrence of the jetting failure in the first head which jets the small liquid droplets.

The liquid droplet jetting apparatus of the present invention may further include a transport mechanism which transports the object in a predetermined transport direction, wherein the second head may be arranged on an upstream side of the first head in the transport direction.

It is assumed that the small liquid droplets are firstly landed on the object such as the recording paper. In this state, when the liquid droplets having larger volumes are further landed thereon, the blur of the liquid becomes severe or serious. In view of the above, in the present invention, the second head, which has the large nozzle diameter, is arranged on the upstream side in the transport direction as compared with the first head which has the small nozzle diameter. According to this arrangement, the large liquid droplets, which are jetted from the second head, are firstly landed on the jetting objective, and then the small liquid droplets, which are jetted from the first head, are landed thereon. Therefore, the blur of the liquid is suppressed.

In the liquid droplet jetting apparatus of the present invention, the liquid tank may be connected to one end of the first head; and the second head may be connected to the other end of the first head.

In this arrangement, the liquid is supplied to one end of the first head from the liquid tank, and the liquid is supplied to the second head from the other end of the first head. Therefore, the flow of the liquid, which is directed from one end to the other end, is generated in the first head. The air bubbles hardly stay in the first head.

In the liquid droplet jetting apparatus of the present invention, each of the first head and the second head may be a fixed type line head which has a nozzle array including a plurality of nozzles arranged in a predetermined arranging direction and which jets the droplet of the liquid while being positioned and fixed at a predetermined position.

In this arrangement, in the fixed line head, the head is not moved, and the liquid droplets are jetted from the nozzles while the head is positioned and fixed at the predetermined position. Therefore, any nozzle, in which the jetting failure arises, cannot be complemented or supplemented with any other normal nozzle. It is necessary to perform the purge from the nozzle in order to dissolve or eliminate the jetting failure. However, in general, the number of nozzles is markedly large in the fixed type line head as compared with the serial head. Therefore, the amount of the liquid, which is discharged when the purge is performed in order to eliminate the jetting failure, is extremely increased as compared with the serial head. As described above, it is affirmed that the influence, which is exerted when the increase in viscosity of the liquid and/or the contamination with air bubbles is/are caused, is large in the fixed type line head as compared with the serial head. Therefore, the application of the present invention is extremely effective for the arrangement provided with the liquid droplet-jetting head of the fixed line type, wherein it is possible to suppress the increase in the viscosity of the liquid and the invasion of bubbles by shortening the total length of the tubes.

The liquid droplet jetting apparatus of the present invention may further include a purge mechanism which has a first cap covering the first nozzles of the first head; a second cap covering the second nozzles of the second head; a cap-driving mechanism driving the first and second caps such that the first cap and the second cap are capable of coming into contact with and separating away from a first nozzle surface of the first head and a second nozzle surface of the second head, respectively, the first nozzle being formed in the first nozzle surface and the second nozzles being formed in the second nozzle surface; and a sucking mechanism connected to the first and second caps to evacuate a first space defined by the first cap and the first nozzle surface and a second space defined by the second cap and the second nozzle surface. In this arrangement, the purge process can be performed for the nozzles in which the discharge failure arises, for example, due to the viscosity-increased liquid and the air bubbles. It is possible to recover or restore the jetting characteristic of the nozzles.

In the liquid droplet jetting apparatus of the present invention, the sucking mechanism may have a suction pump, and a switch which switches a connection target of the suction pump between the first space and the second space. In this arrangement, for example, when the jetting failure arises in only one head of the first and second heads, the purge process can be performed for only one head. It is possible to avoid any consumption of useless liquid droplets. In such a situation, one suction pump can be used for the two heads while being switched. Therefore, it is unnecessary to prepare suction pumps of the same number as that of the heads. It is possible to miniaturize the liquid droplet jetting apparatus.

In the liquid droplet jetting apparatus of the present invention, one of the first and second heads may be a serial type head which jets the droplet of the liquid onto the object while reciprocating in a predetermined direction.

In this arrangement, one (or both) of the first and second heads is/are the so-called serial type head which jets the liquid droplets while making the reciprocating movement in the predetermined scanning direction. Therefore, when the jetting failure arises in a certain nozzle due to the increase in viscosity of the liquid in the tubes and/or the invasion of air bubbles, it is possible to complement the nozzle in which the jetting failure arises, by controlling the scanning velocity of the head and/or the jetting timing of any other nozzle in which the jetting failure does not arise. It is possible to provide a relatively small number of nozzles of the serial head. Therefore, even when the purge is performed to discharge the bubbles and the viscosity-increased liquid from the nozzle in order to eliminate the jetting failure, it is enough to use a small amount of the liquid discharged from the nozzle when the purge is performed.

In the liquid droplet jetting apparatus of the present invention, the liquid may be an ink, and each of the first and second heads may be a piezoelectric type ink-jet head which jets a droplet of the ink onto the object.

According to the present invention, the second head is connected to the liquid tank via the first head. In other words, the liquid tank and the first and second heads are connected in series. Therefore, it is possible to shorten the total length of the tubes as compared with a case in which the liquid tank and the two liquid droplet-jetting heads are connected by means of two tubes respectively (in parallel). Therefore, it is possible to reduce the cost required for the tubes. Further, it is also possible to suppress the increase in viscosity of the liquid in the tube and the invasion of bubbles into the tube.

Further, the second head, which has the large nozzle diameter and which hardly causes the jetting failure, is arranged on the downstream side in the liquid supply direction separated from the liquid tank. Accordingly, it is possible to suppress the occurrence of the jetting failure in the first head having the small nozzle diameter. It is possible to decrease the frequency of the recovery operation such as the purge for recovering the jetting performance.

DESCRIPTION OF THE PREFERRED EMBODIMENTS

Next, an embodiment of the present invention will be explained. This embodiment is an example in which the present invention is applied to a printer provided with two types of heads, i.e., a high resolution printing-adapted head and a high speed printing-adapted head.

Figure 1:
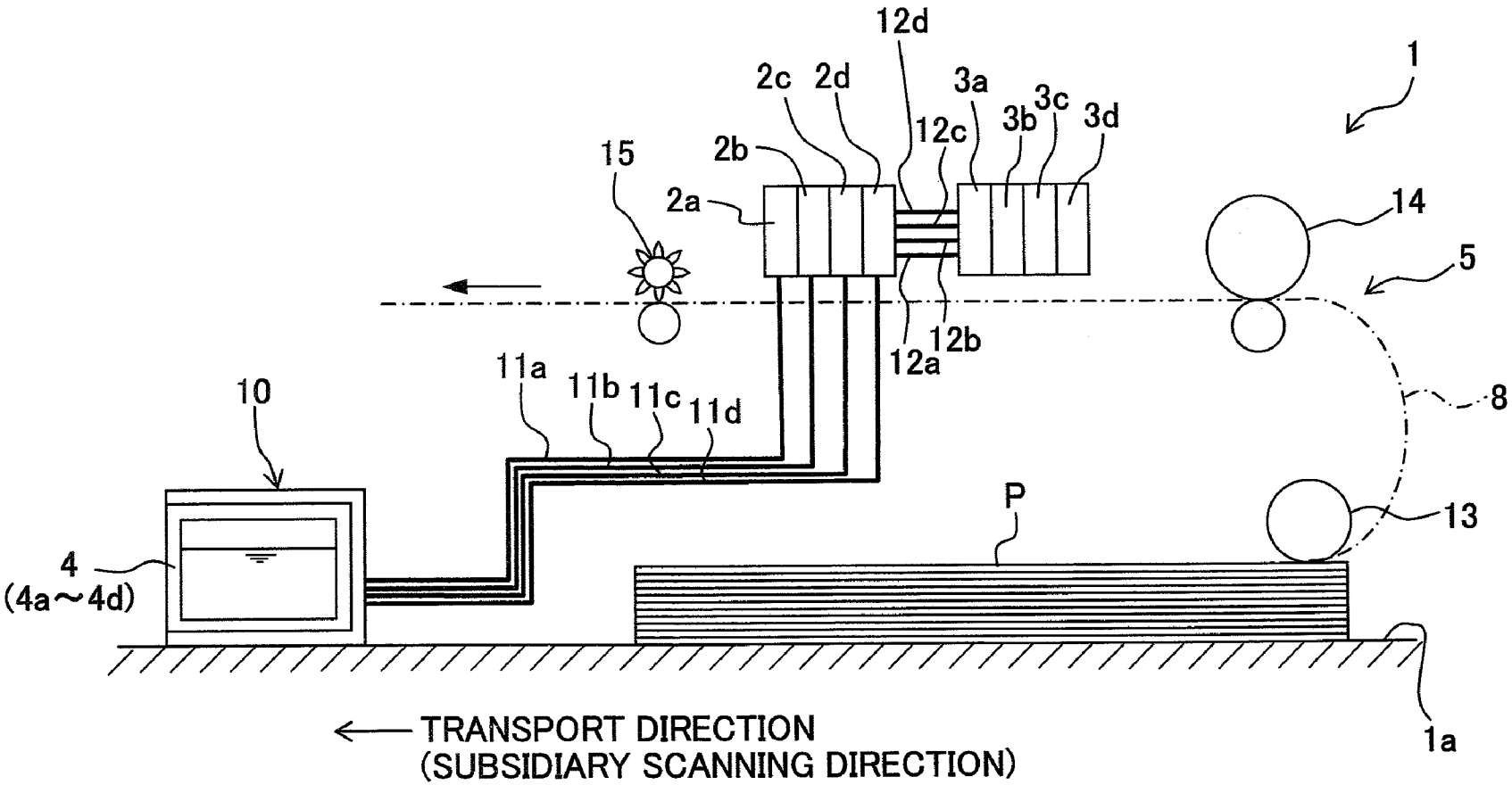
FIG. 1 shows a side view illustrating a schematic arrangement of a printer according to an embodiment of the present invention.
Figure 2:
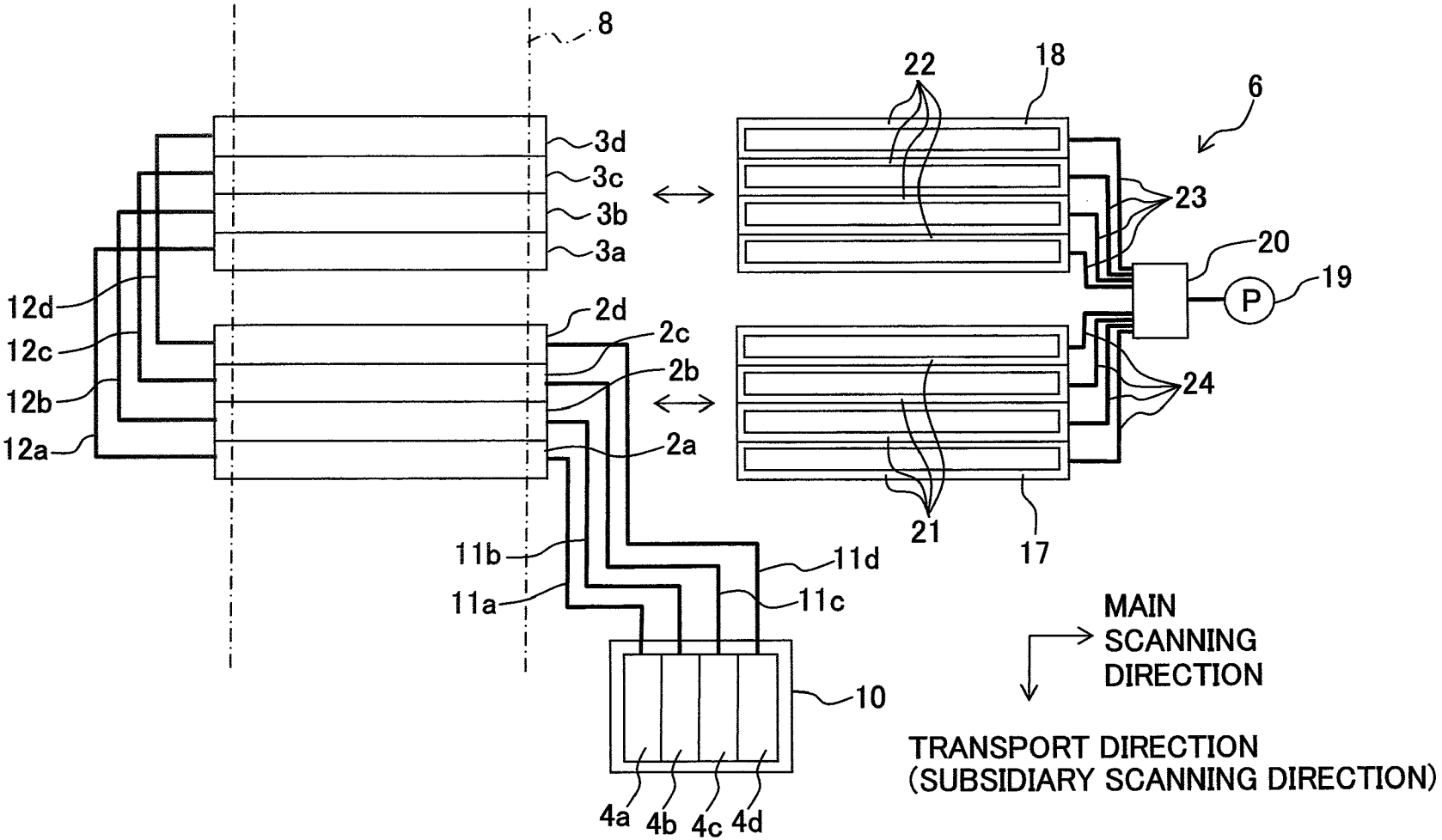
FIG. 2 shows a plan view illustrating the printer shown in FIG. 1.

FIG. 1 shows a schematic side view illustrating the printer 1 of this embodiment. FIG. 2 shows a plan view illustrating the printer 1 shown in FIG. 1. In FIG. 2, for example, rollers 13, 14, 15 shown in FIG. 1 are omitted from the illustration.

As shown in FIGS. 1 and 2, the printer 1 (liquid droplet jetting apparatus) of this embodiment includes four first heads 2*a* to 2*d* (first heads), four second heads 3*a* to 3*d* (second heads), four ink cartridges 4*a* to 4*d* (liquid storage containers, liquid tanks) which store four types of inks respectively, a printing paper transport mechanism 5 (transport mechanism) which transports the printing paper P (jetting objective) along a printing paper transport path 8 (depicted by an alternate long and short dash line in FIG. 1) which is disposed under or below the first heads 2 and the second heads 3, a maintenance mechanism 6 which performs the maintenance for the first heads 2*a* to 2*d* and the second heads 3*a* to 3*d*, and a control unit 7 (see FIG. 11) which manages the overall control of the printer 1. In the following description, when the first heads 2*a* to 2*d* are not distinguished from each other, they are collectively referred to as "first heads 2". The second heads 3*a* to 3*d* are also referred to as "second heads 3" in the same manner as described above.

Nozzle arrays, each of which include a plurality of first nozzles 55*a* (see FIG. 9) arranged in the printing paper widthwise direction (main scanning direction: direction perpendicular to the plane of paper of FIG. 1, left-right direction in FIG. 2) perpendicular to the transport direction of the printing paper P, are formed on the lower surface of the first head 2. Similarly, nozzle arrays, each of which include a plurality of second nozzles 55*b* (see FIG. 10) arranged in the printing paper widthwise direction, are formed on the lower surface of the second head 3. When the first and second nozzles 55*a*, 55*b* are not distinguished from each other, they are collectively referred to as "nozzles 55". The first head 2 and the second head 3 are fixed line type heads respectively. The first head 2 and the second head 3 jet the liquid droplets from the nozzles 55 while the heads 2, 3 are positioned and fixed at predetermined positions. The four first heads 2*a* to 2*d* and the four second heads 3*a* to 3*d* are arranged and aligned in the printing paper transport direction (subsidiary scanning direction) respectively. Further, the four second heads 3*a* to 3*d* are positioned on the upstream side in the printing paper transport direction as compared with the four first heads 2*a* to 2*d*. The four first heads 2*a* to 2*d* jet the inks of yellow, magenta, cyan, and black from the nozzles 55 respectively. The four second heads 3*a* to 3*d* also jet the inks of four colors from the nozzles 55 respectively in the same manner as described above.

The first head 2 is formed with the first nozzles 55*a* each of which has a small nozzle diameter and each of which is capable of jetting small liquid droplets. In other words, the first head 2 is the high resolution printing-adapted head, which is capable of printing the high definition image by jetting the minute liquid droplets onto the printing paper P. On the other hand, the second head 3 is formed with the second nozzles 55*b* each of which has a large nozzle diameter as compared with the first nozzle 55*a* and each of which is capable of jetting large liquid droplets as compared with the first nozzle 55*a*. The second head 3 is the high speed printing-adapted head, which is capable of printing, for example, the letters and the images at a high speed by jetting the large liquid droplets onto the printing paper P.

The following situation is also assumed. That is, the two heads 2, 3 are simultaneously used so that the small liquid droplets are jetted from the first heads 2 having the small nozzle diameter, and the large liquid droplets are also jetted from the second heads 3 having the large nozzle diameter onto one sheet of the printing paper P. In this case, whether the small liquid droplets or the large liquid droplets are landed firstly on the printing paper P is a problem.

According to the knowledge of the present inventors, in view of the color reproduction, it is considered that the color reproduction range is widened when the large liquid droplets are landed firstly and then the small liquid droplets are landed. The reason thereof is as follows. When the large liquid droplets are landed on the printing paper P, the ink is blurred to a large extent not only in the in-plane direction but also the thickness direction of the printing paper P. Therefore, the amount of the color material remaining on the surface of the printing paper P tends to be decreased. On the contrary, the small liquid droplets are blurred to a lesser extent. Therefore, the amount of the color material remaining on the surface of the printing paper P is increased. As a result, the color reproduction range is widened. Reversely, when the small liquid droplets are firstly landed and the large liquid droplets are landed thereafter, then the color material, which remains on the surface of the printing paper P by means of the small liquid droplets, is blurred together with the large liquid droplets. According to the knowledge of the present inventors, the following fact has been revealed. That is, when the small liquid droplets are firstly landed on the printing paper P and the liquid droplets having large volumes are further landed thereafter, then the blur of the ink becomes serious.

In view of the above, in this embodiment, the second heads 3, which jet the large liquid droplets, are arranged on the upstream side in the transport direction as compared with the first heads 2 which jet the small liquid droplets. Accordingly, when the first heads 2 and the second heads 3 are used simultaneously, then the large liquid droplets are firstly landed on the printing paper P, and the small liquid droplets are landed thereafter. Therefore, the color reproduction range is widened, and the blur of the ink is suppressed as well.

The inks of four colors of yellow, magenta, cyan, and black are stored in the four ink cartridges 4*a* to 4*d* respectively. The four ink cartridges 4*a* to 4*d* are detachably installed to a holder 10 provided fixedly on the bottom surface 1*a* of the printer body respectively. When the four ink cartridges 4*a* to 4*d* are not distinguished from each other, they are collectively referred to as "ink cartridges 4".

The four ink cartridges 4*a* to 4*d* and the four first heads 2*a* to 2*d* are connected directly by means of four flexible tubes 11*a* to lid composed of synthetic resin or the like respectively. The four first heads 2*a* to 2*d* and the four second heads 3*a* to 3*d* are connected by means of four flexible tubes 12*a* to 12*d* composed of synthetic resin or the like. In other words, the second heads 3 are connected to the ink cartridges 4 via the first heads 2. In other words, the ink cartridge 4 which stores the ink of a certain type and the two heads (first head 2 and second head 2) which use the ink are connected in series in an order of the ink cartridge 4, the first head 2, and the second head 3.

The printing paper transport mechanism 5 is provided with, for example, a paper feeding roller 13, a main roller 14, a spur roller 15, and drive motors 82, 83, 84 (see FIG. 11) which drive the rollers 13, 14, 15 respectively. The printing paper transport mechanism 5 transports the printing paper P along the printing paper transport path 8. That is, one sheet is extracted from stacked sheets of the printing paper P by means of the paper feeding roller 13. The extracted printing paper P is transported to the first heads 2 and the second heads 3 by means of the cooperation of the main roller 14 and a press roller 16. Further, the printing paper P is discharged by the spur roller 15 after printing the image or the like by the first heads 2 and the second heads 3.

The maintenance mechanism 6 is capable of executing the suction purge for the first heads 2 and the second heads 3. Therefore, the maintenance mechanism 6 is capable of recovering the liquid droplet jetting performance by sucking the inks from the nozzles 55 and discharging the viscosity-increased ink, the bubbles, the dust or the like together with the inks. As shown in FIG. 2, the maintenance mechanism 6 is provided with first caps 17 which correspond to the four first heads 2, second caps 18 which correspond to the four second heads 3, and a suction pump 19 which is connected to the first caps 17 and the second caps 18 respectively.

The first caps 17 have four lip sections 21 which are elongated in the printing paper widthwise direction (main scanning direction) and which are capable of covering the lower surfaces (liquid droplet-jetting surfaces) of the four first heads 2 respectively. Similarly, the second caps 18 also have four lip sections 22 which are elongated in the printing paper widthwise direction and which are capable of covering the lower surfaces (liquid droplet-jetting surfaces) of the four second heads 3 respectively.

When the suction purge is not performed for the first heads 2 and the second heads 3, as shown in FIG. 2, the first caps 17 and the second caps 18 wait in the area (waiting position) disposed outside the printing paper transport path 8 in the printing paper widthwise direction (main scanning direction).

Both of the first heads 2 and the second heads 3 are driven by a head-lifting mechanism 221 (refer to FIG. 11) between the liquid droplet jetting position at which the liquid droplets are jetted and the maintenance position which is separated in the upward direction (frontward direction in relation to the plane of paper of FIG. 2) from the printing paper transport path 8 as compared with the liquid droplet jetting position. When the suction purge is performed for the first heads 2 and the second heads 3, the first heads 2 and the second heads 3 are driven to the upward maintenance position by means of the head-lifting mechanism 221 respectively. After that, the first caps 17 and the second caps 18 are driven by a cap-driving mechanism 217 (refer to FIG. 11) from the waiting position shown in FIG. 2 to the position of the printing paper transport path 8. Accordingly, the upper surfaces of the first heads 2 are covered with the lip sections 21 of the first caps 17, and the upper surfaces of the second heads 3 are covered with the lip sections 22 of the second caps 18.

The first caps 17 and the second caps 18 are connected to a switching unit 20 by means of tubes 23, 24 respectively. Further, the switching unit 20 is connected to the suction pump 19. The connection target of the suction pump 19 is switched by the switching unit 20 between the first caps 17 and the second caps 18. When the suction pump 19 is connected to the first caps 17, the inks can be sucked from the first nozzles 55*a* of the first heads 2 by means of the suction pump 19 to perform the suction purge for the first heads 2. On the other hand, when the suction pump 19 is connected to the second caps 18, the inks can be sucked from the second nozzles 55*b* of the second heads 3 by means of the suction pump 19 to perform the suction purge for the second heads 3. In this way, the connection target of the suction pump 19 can be switched between the first and second caps 17, 18. Therefore, for example, when the jetting failure arises in only one head of the first and second heads 2, 3, the purge process can be performed for only the one head in which the jetting failure arises. It is possible to avoid the consumption of any useless liquid droplet. In such a situation, it is unnecessary to prepare the suction pumps of the same number as that of the heads, because one suction pump can be used in the switching manner between the two heads. It is possible to miniaturize the liquid droplet jetting apparatus.

Figure 3:
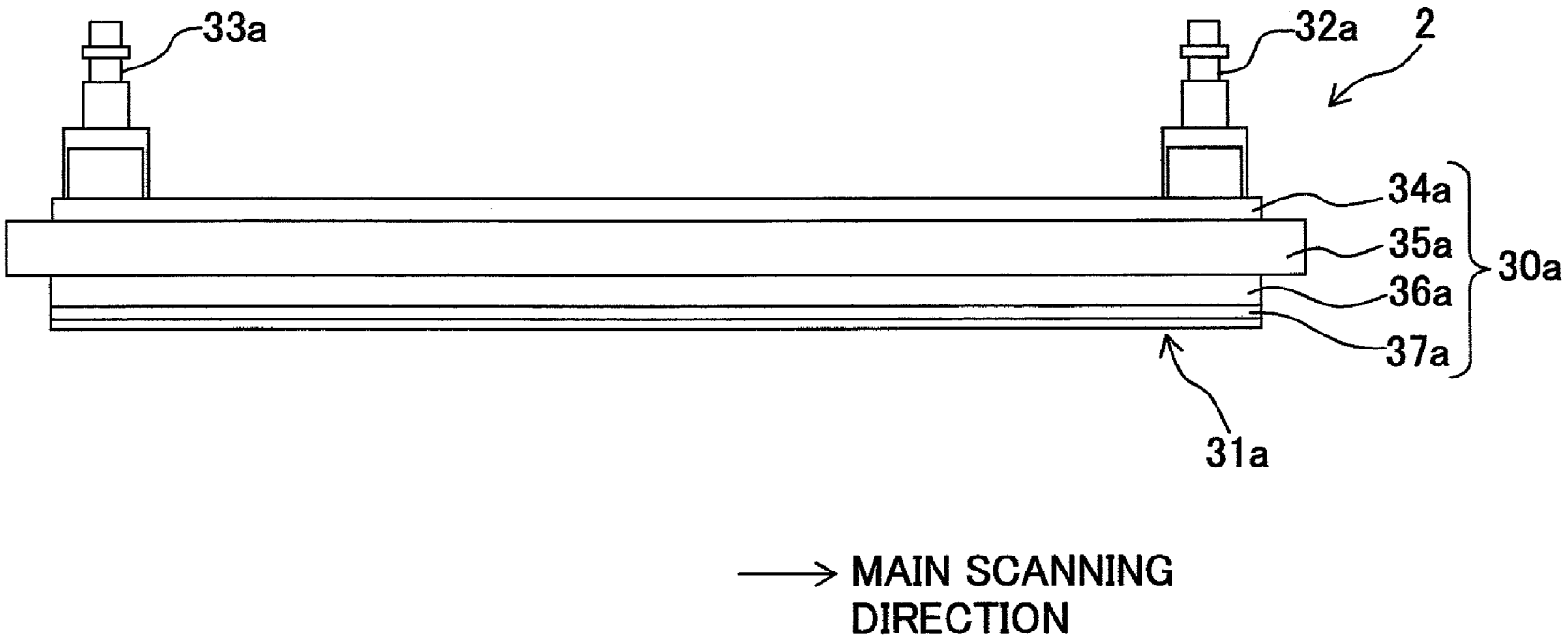
FIG. 3 shows a front view illustrating a first head.
Figure 4:
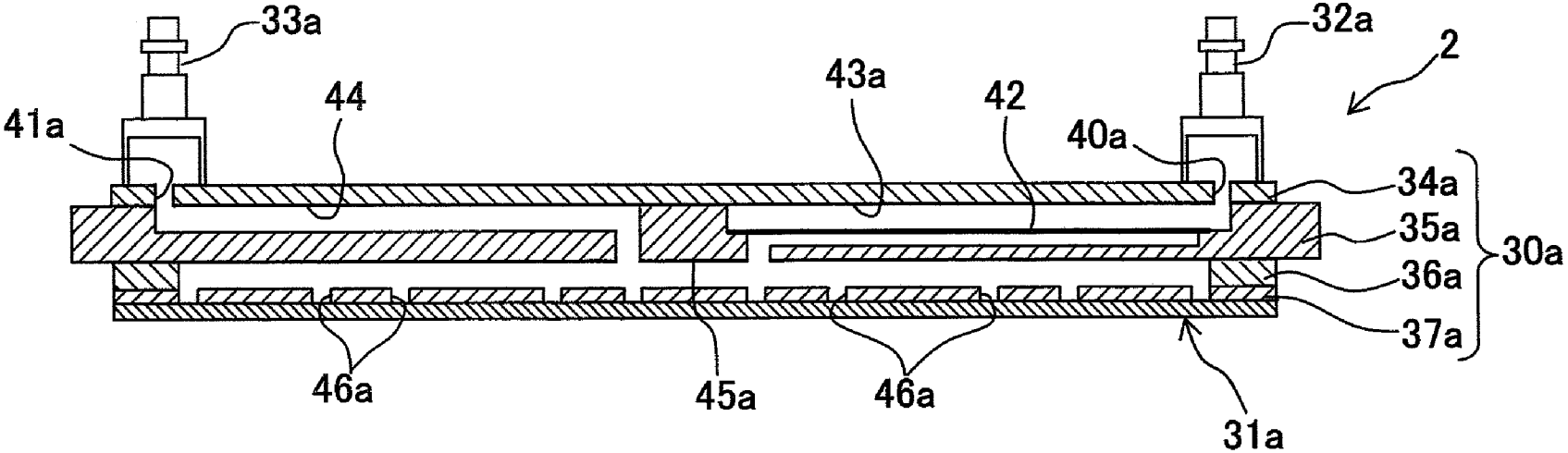
FIG. 4 shows a vertical sectional view illustrating the first head shown in FIG. 3.
Figure 5:
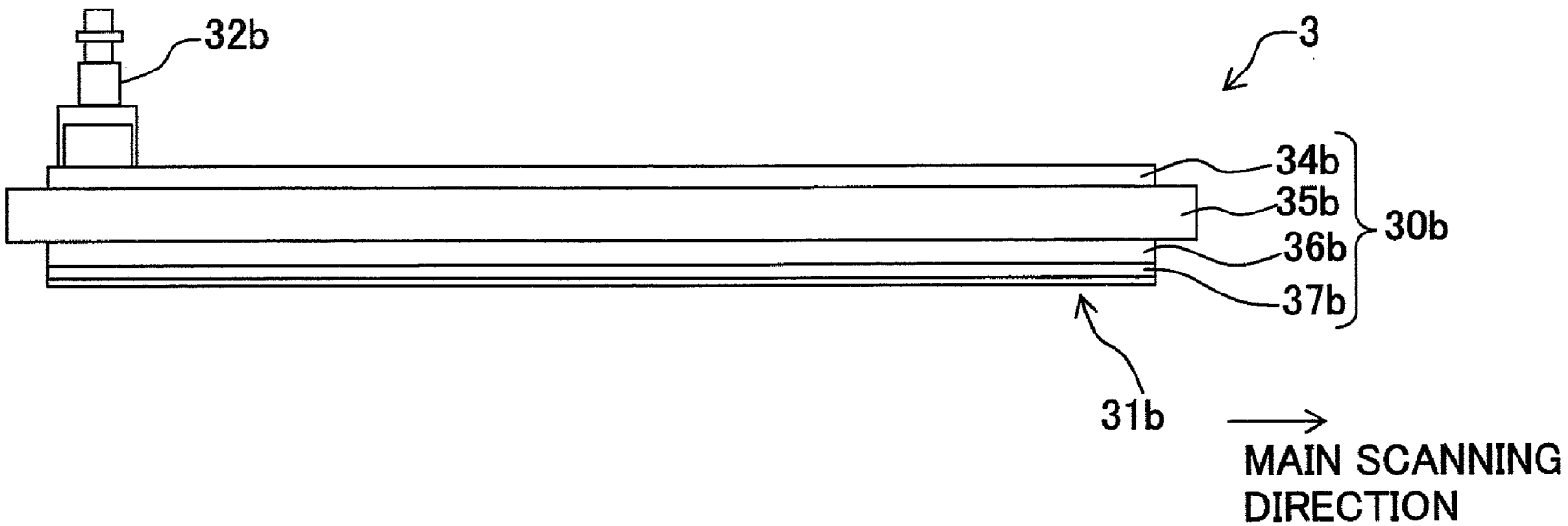
FIG. 5 shows a front view illustrating a second head.
Figure 6:
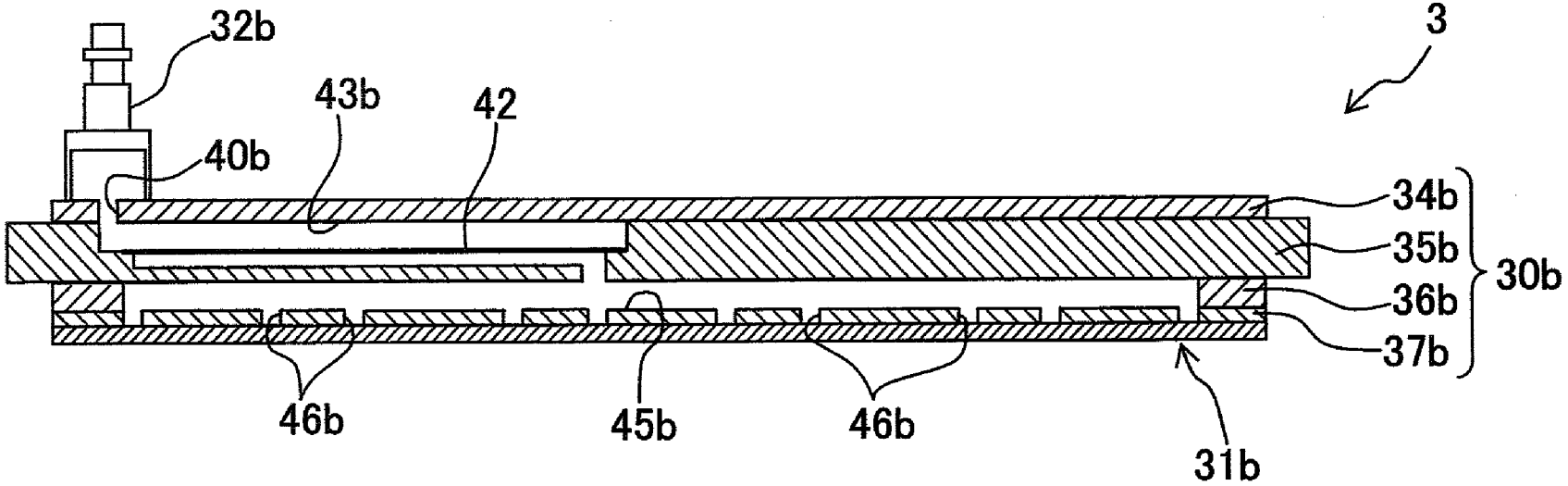
FIG. 6 shows a vertical sectional view illustrating the second head shown in FIG. 5.

Next, an explanation will be made in detail about the specified structures of the first heads 2 and the second heads 3. All of the four first heads 2*a* to 2*d* have the same structure, and all of the four second heads 3*a* to 3*d* have the same structure as well. Therefore, the following description will be made about one of the first heads 2 and one of the second heads 3 respectively. FIG. 3 shows a front view illustrating the first head 2, and FIG. 4 shows a vertical sectional view illustrating the first head 2 shown in FIG. 3. FIG. 5 shows a front view illustrating the second head 3, and FIG. 6 shows a vertical sectional view illustrating the second head 3 shown in FIG. 5.

Figure 8:
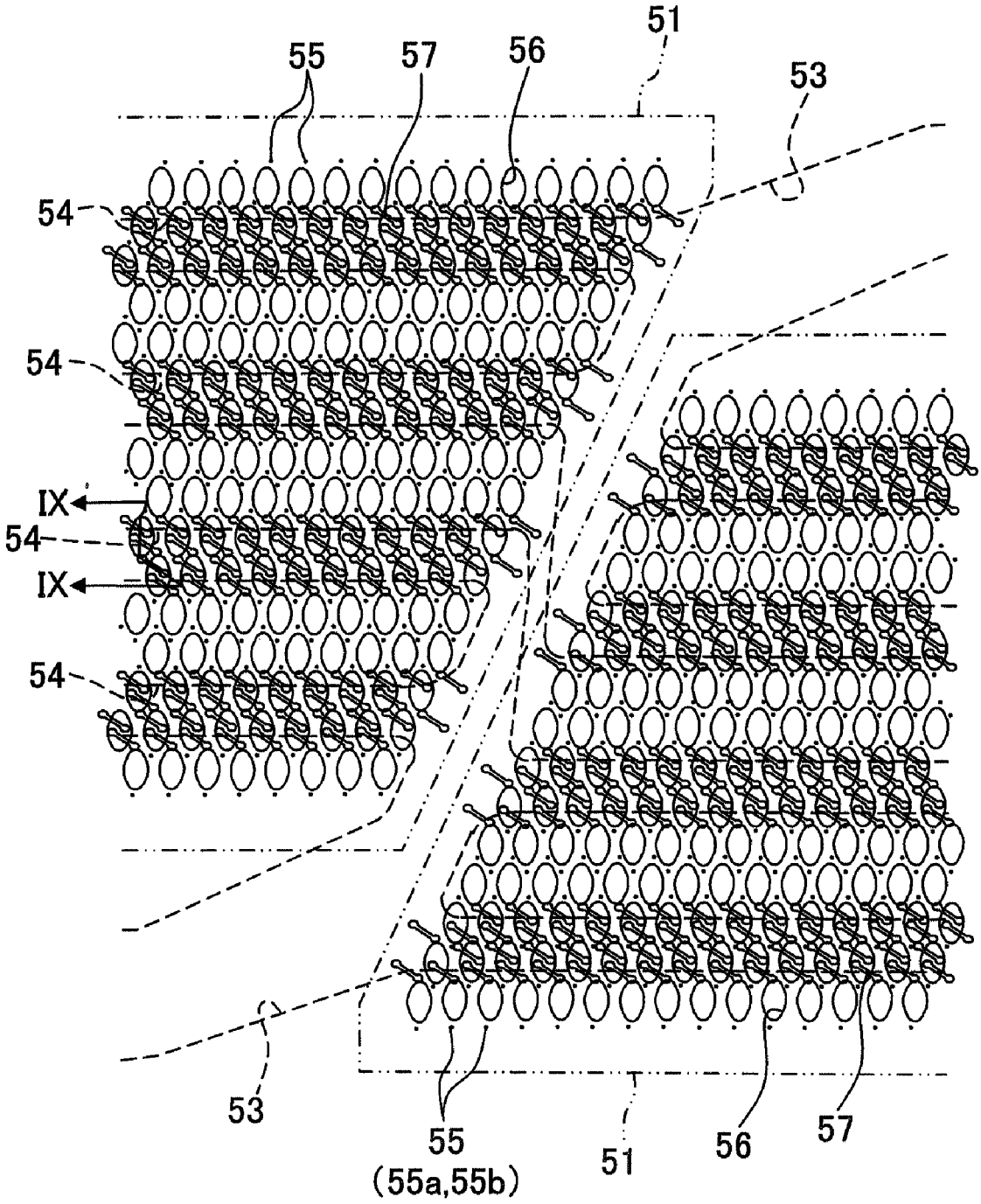
FIG. 8 shows a magnified view illustrating an area surrounded by alternate long and short dash lines shown in FIG. 7.
Figure 9:
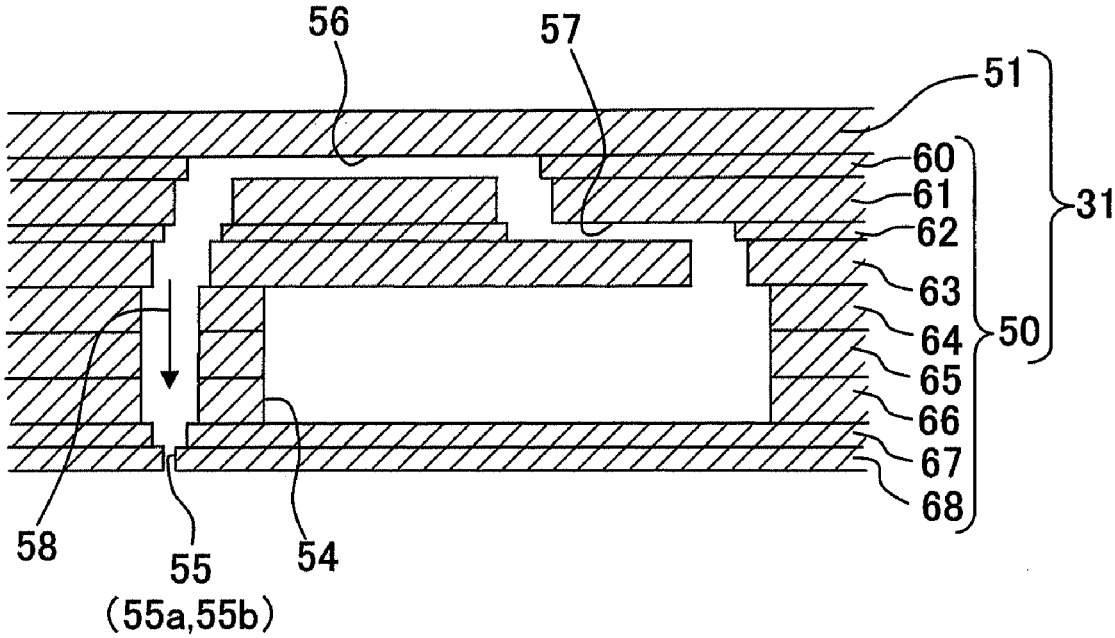
FIG. 9 shows a partial sectional view taken along a line IX-IX shown in FIG. 8.

As shown in FIGS. 3 and 4, the first head 2 includes a first reservoir unit 30*a* which has an ink inlet section 32*a* and an ink outlet section 33*a*, and a head body 31*a* which is joined to the lower surface of the first reservoir unit 30*a* and which is formed with the first nozzles 55*a* (see FIGS. 8 and 9). On the other hand, as shown in FIGS. 5 and 6, the second head 3 includes a second reservoir unit 30*b* which has an ink inlet section 32*b*, and a head body 31*b* which is joined to the lower surface of the second reservoir unit 30*b* and which has the second nozzles 55*a* (see FIGS. 8 and 9).

The structure of the first reservoir unit 30*a* is slightly different from the structure of the second reservoir unit 30*b* on account of the presence or absence of the ink outlet section 33*a*. On the other hand, the structure of the head body 31*a* of each of the first heads 2 is approximately the same as the structure of the head body 31*b* of each of the second heads 3 except that the first nozzles 55*a* and the second nozzles 55*b*, which are formed in the head bodies 31*a*, 31*b* respectively, have the different diameters.

At first, an explanation will be made about the first reservoir unit 30*a* and the second reservoir unit 30*b*. As shown in FIGS. 3 and 4, the first reservoir unit 30*a* of each of the first heads 2 is a stack of four plates 34*a* to 37*a* which are elongated in the printing paper widthwise direction (main scanning direction). The ink inlet section 32*a* and the ink outlet section 33*a* are provided at the both ends in the longitudinal direction of the uppermost plate 34*a*. The ink inlet section 32*a* is connected to the ink cartridge 4 via the tube 11 (see FIGS. 1 to 3). The ink outlet section 33*a* is connected to one of the second heads 3 via the tube 12 (see FIGS. 1 to 3).

As shown in FIG. 4, through-holes 40*a*, 41*a*, which are communicated with the ink inlet section 32*a* and the ink outlet section 33*a* respectively, are formed through the plate 34*a*. The second plate 35*a*, which is counted from the uppermost position, is formed with a filter-accommodating space 43*a* which is connected to the ink inlet section 32*a* via the through-hole 40*a* and which accommodates a filter 42 for removing impurities such as the dust and the bubbles contained in the ink. In the second plate 35*a*, an ink outlet passage 44 is formed which is connected to the ink outlet section 33*a* via the through-hole 41*a* and which is composed of a recess formed by the half etching and a hole connected to the recess. The third plate 36*a*, which is counted from the uppermost position, is formed with an ink reservoir 45*a* extending over the substantially entire region in relation to the longitudinal direction (main scanning direction). The ink reservoir 45*a* is communicated with both of the filter-accommodating space 43*a* and the ink outlet passage 44 which are formed for the plate 35*a* disposed just above. Further, the lowermost plate 37*a* is formed with a plurality of ink supply holes 46*a* each of which makes communication between the ink reservoir 45*a* and the head body 31*a*.

Therefore, the ink, which is supplied from each of the ink cartridges 4 via one of the tubes 11 to one of the first heads 2, is introduced into the ink reservoir 45*a* from the ink inlet section 32*a* via the through-hole 40*a* and the filter-accommodating space 43*a*. The ink, which is contained in the ink reservoir 45*a*, is supplied from the plurality of ink supply holes 46*a* to the head body 31*a*. On the other hand, a part of the ink, which is contained in the ink reservoir 45*a*, is derived to one of the second heads 3 from the ink outlet section 33*a* via the ink outlet passage 44.

The ink inlet section 32*a* to which the ink is supplied from one of the ink cartridges 4 and the ink outlet section 33*a* which is provided to supply the ink to one of the second heads 3 are provided at the both ends in the longitudinal direction of the first reservoir unit 30*a* of each of the first heads 2. Therefore, the ink, which is supplied to one end (right end as shown in FIGS. 3 and 4) of one of the first heads 2, is supplied to one of the second heads 3 from the other end (left end as shown in FIGS. 3 and 4) of the one of the first heads 2. Therefore, the bubbles, which are mixed in the ink, hardly stay in the first heads 2.

As shown in FIGS. 5 and 6, the second reservoir unit 30*b* of the second head 3 is a stack of four plates 34*b* to 37*b* which are elongated in the printing paper widthwise direction (main scanning direction) in the same manner as the first reservoir unit 30*a*. However, the second reservoir unit 30*b* is used to introduce the ink from the outside (from the first reservoir unit 30*a* of each of the first heads 2). It is unnecessary for the second reservoir unit 30*b* to further derive a part of the introduced ink to the outside. Therefore, the second reservoir unit 30*b* is slightly different from the first reservoir unit 30*a* in relation to the structure.

The ink inlet section 32*b* is provided at one end in the longitudinal direction of the uppermost plate 34*b* of the second reservoir unit 30*b*. The ink inlet section 32*b* is connected to the ink outlet section 33*a* (see FIGS. 3 and 4) of the first reservoir unit 30*a* described above via the tube 12 (see FIGS. 1 to 3). The ink outlet section 33*a* of the first reservoir unit 30*a* described above and the ink inlet section 32*b* of the second reservoir unit 30*b* are provided at the ends (left ends) disposed on the same side in relation to the longitudinal direction (main scanning direction) thereof. In other words, the ink outlet section 33*a* and the ink inlet section 32*b* are formed at the left ends as viewed in FIG. 2 of the first and second reservoir units 30*a*, 30*b* respectively. Therefore, as shown in FIG. 2, it is possible to suppress the length of the tubes 12 to the minimum for connecting the first heads 2 (first reservoir unit 30*a*) and the second heads 3 (second reservoir unit 30*b*).

As shown in FIG. 6, the internal structure of the second reservoir unit 30*b* is the same as that of the first reservoir unit 30*a* except that the ink outlet passage 44 (see FIG. 4) is not provided. Therefore, the ink, which is supplied from the first reservoir unit 30*a* of each of the first head 2 via one of the tubes 12 to one of the second heads 3, is introduced into the ink reservoir 45*b* from the ink inlet section 32*b* via the through-hole 40*b* and the filter-accommodating space 43*b*. Further, the ink, which is contained in the ink reservoir 45*b*, is supplied to the head body 31*b* from a plurality of ink supply holes 46*b*.

Figure 7:
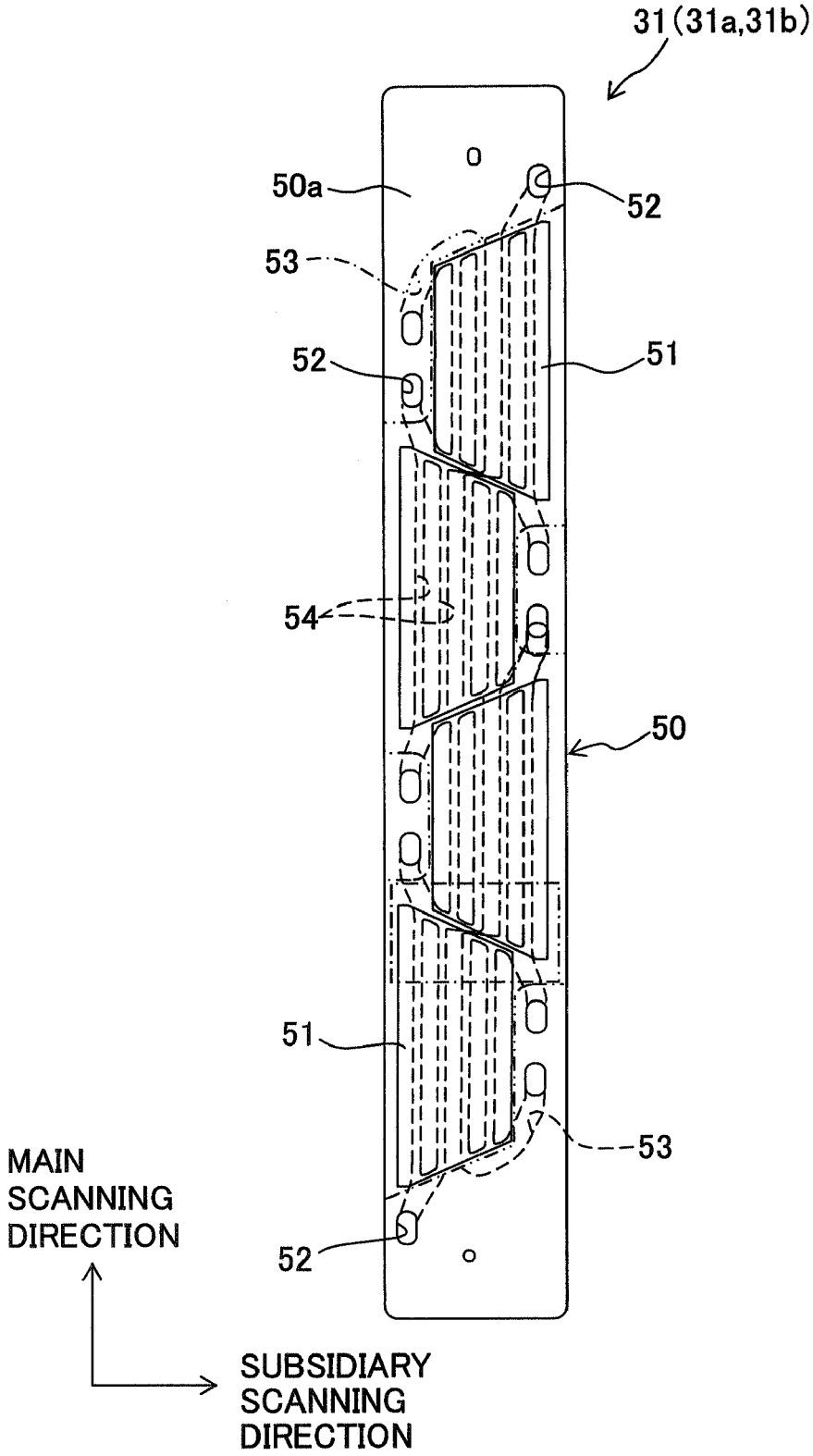
FIG. 7 shows a plan view illustrating a main head body.
Figure 10A:
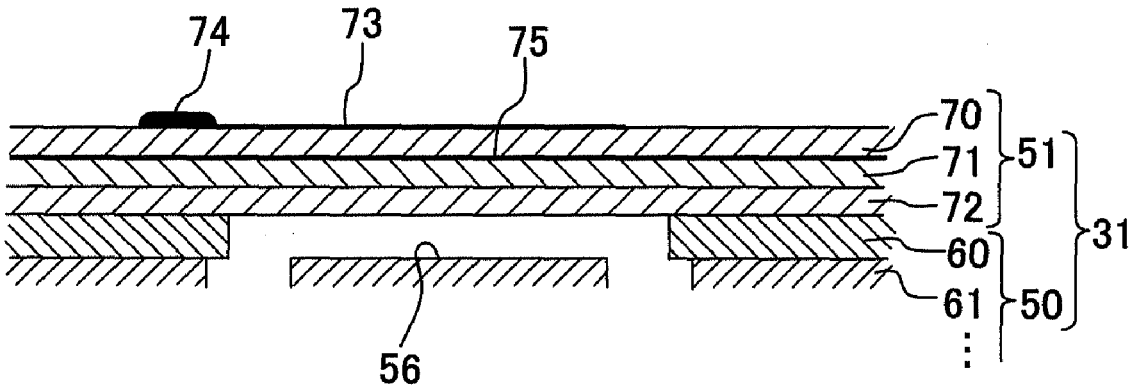
FIG. 10A shows a magnified sectional view illustrating an actuator unit.
Figure 10B:
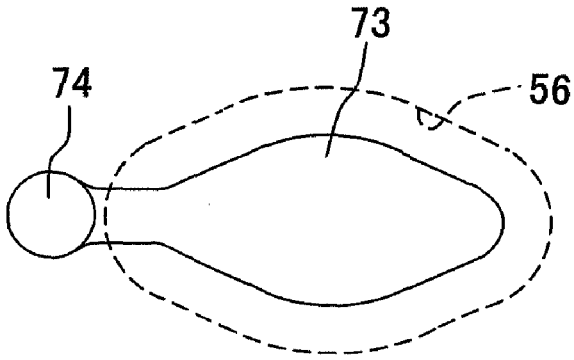
FIG. 10B shows a plan view illustrating an individual electrode shown in FIG. 10A.

Next, the head body will be explained. However, the structure of the head body 31*a* of each of the first heads 2 is approximately the same as that of the head body 31*b* of one of the second heads 3 except that the diameter of the nozzles 55 differs. In the following description, when the head bodies 31*a*, 31*b* are not distinguished from each other, they are collectively referred to as "head body 31". FIG. 7 shows a plan view illustrating the head body 31. FIG. 8 shows a magnified view illustrating the area surrounded by alternate long and short dash lines shown in FIG. 7. In FIG. 8, for the purpose of convenience of the explanation, the pressure chambers 56, the apertures 57, and the nozzles 55, which are disposed under or below the actuator unit 51 and which are to be depicted by broken lines, are depicted by solid lines. FIG. 9 shows a partial sectional view taken along a IX-IX line shown in FIG. 8. FIG. 10A shows a magnified sectional view illustrating the actuator unit 51. FIG. 10B shows a plan view illustrating the individual electrode 73 shown in FIG. 10A.

As shown in FIG. 7, the head body 31 includes a flow passage unit 50 which is formed with ink flow passages including the nozzles 55 and the pressure chambers 56, and four actuator units 51 which are fixed to the upper surface 50*a* of the flow passage unit 50 and which apply the pressure to the ink contained in the pressure chambers 56.

The flow passage unit 50 is formed to have a rectangular parallelepiped shape which is approximately the same as the shapes of the reservoir units 30*a*, 30*b* (collectively referred to as "reservoir units 30") as viewed in a plan view. A plurality of ink supply ports 52 (ten ports in this embodiment), which correspond to the plurality of ink supply holes 46 (see FIGS. 4 and 6) of the reservoir unit 30, are open on the upper surface 50*a* of the flow passage unit 50. Manifold flow passages 53 communicated with the ink supply ports 52 and subsidiary manifold flow passages 54 branched from the manifold flow passages 53 are formed in the flow passage unit 50. The lower surface of the flow passage unit 50 is the liquid droplet-jetting surface. As shown in FIGS. 8 and 9, the plurality of first nozzles 55*a* or second nozzles 55*b* are arranged in a matrix form in the two directions (in the main scanning direction and the direction intersecting the main scanning direction). The plurality of pressure chambers 56 are also arranged in a matrix form in the same manner as the nozzles 55 on the fixed surface of the actuator unit 51 of the flow passage unit 50.

As shown in FIG. 9, the flow passage unit 50 includes nine plates made of a metal such as stainless steel, i.e., a cavity plate 60, a base plate 61, an aperture plate 62, a supply plate 63, manifold plates 64, 65, 66, a cover plate 67, and a nozzle plate 68. The plates are stacked in this order from the upper position.

The cavity plate 60 is formed with a plurality of through-holes which correspond to the ink supply ports 52 (see FIG. 7), and a plurality of substantially rhombic through-holes which correspond to the pressure chambers 56. The base plate 61 is formed with communication holes which make communication between the pressure chambers 56 and the apertures 57 and communication holes which make communication between the pressure chambers 56 and the nozzles 55 in relation to the respective pressure chambers 56. Further, the base plate 61 is formed with communication holes (not shown) which make communication between the ink supply ports 52 and the manifold flow passages 53.

The aperture plate 62 is formed with through-holes which serve as the apertures 57 and communication holes which make communication between the pressure chambers 56 and the nozzles 55 in relation to the respective pressure chambers 56. Further, the aperture plate 62 is formed with communication holes (not shown) which make communication between the ink supply ports 52 and the manifold flow passages 53. The supply plate 63 is formed with communication holes which make communication between the apertures 57 and the subsidiary manifold flow passages 54 and communication holes which make communication between the pressure chambers 56 and the nozzles 55 in relation to the respective pressure chambers 56. Further, the supply plate 63 is formed with communication holes (not shown) which make communication between the ink supply ports 52 and the manifold flow passages 53.

The manifold plates 64, 65, 66 are formed with communication holes, which make communication between the pressure chambers 56 and the nozzles 55, and through-holes which serve as the manifold flow passages 53 and the subsidiary manifold flow passages 54 in relation to the respective pressure chambers 56. The manifold flow passage 53 and the subsidiary manifold flow passages 54 are connected to one another when the manifold plates 64, 65 and 66 are stacked. The cover plate 67 is formed with communication holes which make communication between the pressure chambers 56 and the nozzles 55 in relation to the respective pressure chambers 56.

The nozzle plate 68 is formed with holes which correspond to the nozzles 55 in relation to the respective pressure chambers 56. In other words, the holes, which correspond to the first nozzles 55*a*, are formed for each of the first heads 2, and the holes, which correspond to the second nozzles 55*b*, are formed for each of the second heads 3. It is noted that the diameter of the nozzles 55 formed through the nozzle plate 68 differs between the head body 31*a* of the first heads 2 and the head body 31*b* of the second heads 3. That is, the nozzle diameter of the first nozzles 55*a* formed through the nozzle plate 68 of the first heads 2 is about ten-odd μm (a dozen or more μm), while the nozzle diameter of the second nozzle 55*b* formed through the nozzle plate 68 of the second heads 3 is about 20 to 60 μm. As described above, the nozzle diameter of the first nozzles 55*a* is smaller than the nozzle diameter of the second nozzles 55*b*. The volume of the liquid droplet jetted from the second nozzles 55*b* is about 5 to 20 pl, while the minute liquid droplet having a volume of about 1 to 1.5 pl can be jetted from the first nozzle 55*a*.

The manifold flow passages 53, the subsidiary manifold flow passages 54, and the large number of individual ink flow passages 58 extending from the outlets of the subsidiary manifold flow passages 54 via the pressure chambers 56 to the nozzles 55 are formed in the flow passage unit 50, when the plates 60 to 68 are positioned and stacked with each other.

Therefore, the ink, which is supplied into the flow passage unit 50 from the reservoir unit 30 (30*a*, 30*b*) via the ink supply ports 52, is distributed from the manifold flow passages 53 to the subsidiary manifold flow passages 54. Further, the ink, which is contained in the subsidiary manifold flow passages 54, is allowed to flow into the large number of individual ink flow passages 58 respectively. The ink arrives at the nozzles 55 (first nozzles 55*a* or second nozzles 55*b*) via the apertures 57 serving as throttle flow passages and via the pressure chambers 56 in the respective individual ink flow passages 58.

Next, the actuator unit 51 will be explained. As shown in FIG. 7, the four actuator units 51 have trapezoidal shapes as viewed in a plan view respectively. The actuator units 51 are arranged in a zigzag form so that they are not overlapped with the ink supply ports 52. Two sides of the four sides of each of the actuator units 51, which are opposed to one another in parallel, extend in the longitudinal direction of the flow passage unit 50. Oblique sides of the adjoining actuator units 51 are overlapped with each other in the widthwise direction (subsidiary scanning direction) of the flow passage unit 50.

As shown in FIG. 10A, the actuator unit 51 is constructed by three piezoelectric sheets 70, 71, 72 each of which is composed of a ceramics material of the lead titanate zirconate (PZT) system having the ferroelectricity. The individual electrodes 73 are formed at the positions each of which is overlapped with one of the pressure chambers 56 and which is disposed on the upper surface of the piezoelectric sheet 70 of the uppermost layer. A common electrode 75, which is formed to cover the surface of the piezoelectric sheet entirely, is allowed to intervene between the piezoelectric sheet 70 of the uppermost layer and the piezoelectric sheet 71 disposed therebelow. As shown in FIG. 10B, each of the individual electrodes 73 has a substantially rhombic shape which is similar to one of the pressure chambers 56 as viewed in a plan view. One of two acute angle portions of each of the substantially rhombic individual electrodes 73 extends outwardly. A circular land 74, which is electrically connected to each of the individual electrodes 73, is provided at the forward end of the one of the acute angle portions.

The common electrode 75 is maintained at the ground electric potential in the area covering all of the pressure chambers 56. On the other hand, each of the lands 74 is connected to one of the terminals of a driver IC 76 (see FIG. 12) by the aid of unillustrated Flexible Printed Circuit (FPC). Therefore, the driver IC 76 is capable of selectively controlling the electric potentials of the individual electrodes 73.

A method for driving the actuator units 51 will now be described. The piezoelectric sheet 70 is polarized in the thickness direction thereof. When the electric potential, which is different from that of the common electrode 75, is applied to the individual electrodes 73, the electric field is applied in the polarization direction of the piezoelectric sheet 70. In this situation, the portion of the piezoelectric sheet 70, to which the electric field is applied, acts as the active portion, and the active portion is distorted (deformed) in accordance with the piezoelectric effect. As shown in FIG. 10A, the piezoelectric sheets 70 to 72 are fixed to the surface of the cavity plate 60 which comparts the pressure chambers 56. A difference appears in the deformation in the in-plane direction between the electric potential-applied portion of the piezoelectric sheet 70 and the piezoelectric sheets 71, 72 disposed therebelow. Therefore, the piezoelectric sheets 70 to 72 cause the deformation (unimorph deformation) as a whole so that the piezoelectric sheets 70 to 72 are convex toward the pressure chambers 56. Accordingly, the pressure (jetting energy) is applied to the ink contained in one of the pressure chambers 56, and the ink droplets are jetted from one of the nozzles 55.

Next, an explanation will be made with reference to a block diagram shown in FIG. 11 about the electric arrangement of the printer 1 mainly concerning the control unit 7. The control unit 7 shown in FIG. 11 comprises, for example, a central processing unit (CPU), a read only memory (ROM) in which, for example, various programs and data are stored to control the overall operation of the printer 1, and a random access memory (RAM) which temporarily stores, for example, data processed by CPU.

Figure 11:
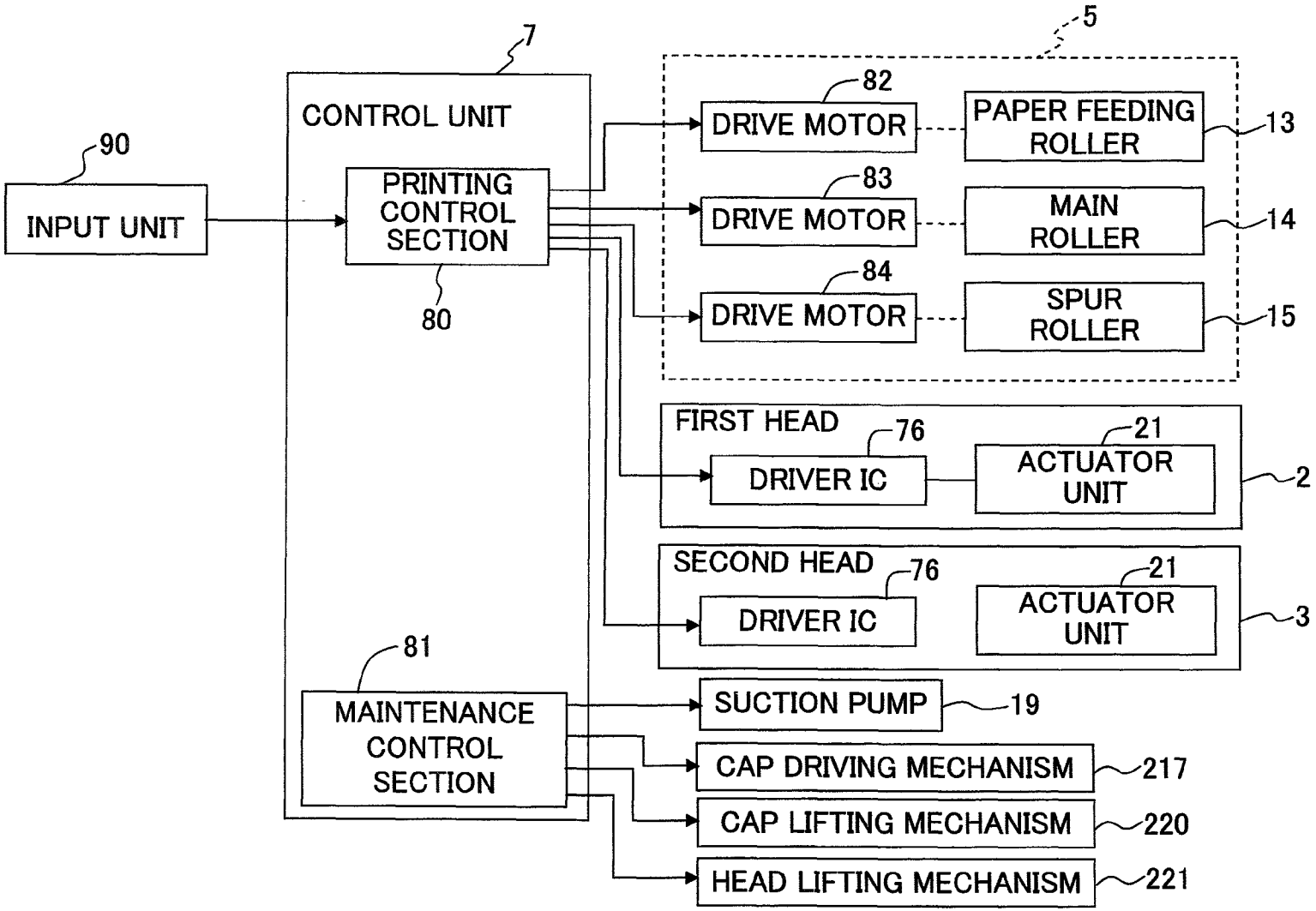
FIG. 11 shows a block diagram schematically illustrating an electric arrangement of the printer.

As shown in FIG. 11, the control unit 7 further includes a printing control section 80 which controls the printing on the printing paper P, and a maintenance control section 81 which controls the maintenance mechanism 6 to perform the maintenance such as the suction purge to recover the jetting performance of the first nozzles 55*a* and the second nozzles 55*b*. The functions of the printing control section 80 and the maintenance control section 81 are realized by executing various control programs stored in ROM of the control unit 7 by means of CPU.

The printing control section 80 controls, for example, the driver ICs 76 for the first heads 2 and the second heads 3 and the drive motors 82, 83, 84 for controlling the rollers 13, 14, 15 which transport the printing paper P and which are included in the printing paper transport mechanism 5 respectively, to print the image or the like on the printing paper P on the basis of the data inputted from an input unit (input device) 90 such as PC.

More specifically, when the high resolution printing, in which the high definition image is printed, is requested from the input unit 90, the printing control section 80 controls the driver IC 76 for the first heads 2 adapted to the high resolution printing so that the minute liquid droplets are jetted from the first nozzles 55*a* of the first heads 2 to print the high definition image on the printing paper P. On the other hand, when the low resolution printing such as the text printing is requested from the input unit 90, the printing control section 80 controls the driver IC 76 for the second heads 3 adapted to the high speed printing so that the large volume liquid droplets are jetted from the second nozzles 55*b* of the second heads 3 to print the letters and/or the image at a high speed on the printing paper P.

The maintenance control section 81 controls, for example, the suction pump 19 and the cap-driving mechanism 220 (see FIG. 11) for driving the first caps 17 and the second caps 18 (see FIG. 2) to suck and discharge the inks from the plurality of nozzles 55*a*, 55*b* of the first heads 2 and the second heads 3 by the aid of the cap members 17, 18 (suction purge). In this arrangement, the maintenance control section 81 is capable of making the control so that both of the first heads 2 and the second heads 3 are subjected to the suction purge. It is also possible to perform the suction purge for only any one of the heads. The following situation is assumed, in which the suction purge is performed for only one of the heads and the suction purge is not performed for the other heads. That is, for example, any jetting failure arises in only the nozzles of one of the heads.

The following effect is obtained by the printer 1 of this embodiment constructed as described above. As shown in FIGS. 1 and 2, each of the second heads 3 is connected to one of the ink cartridges 4 via one of the first heads 2, and the ink is supplied to each of the second heads 3 via one of the first heads 2. When one ink cartridge 4 and two heads 2, 3 are connected in series as described above, it is possible to shorten the total length of the tubes (total length of the tubes 11 and the tubes 12) as compared with a case in which one ink cartridge 4 and two heads 2, 3 are connected by means of distinct tubes respectively (parallel connection). Therefore, it is possible to reduce the cost required for the tubes. Further, it is also possible to suppress the increase in viscosity of the ink in the tubes and the invasion of the air bubbles into the tubes.

Both of the first heads 2 and the second heads 3 of this embodiment are the fixed type line heads. In other words, the first heads 2 (second heads 3) have the nozzle arrays each including the large number of nozzles 55 arranged in one direction (main scanning direction), and the first heads 2 (second head 3) jet the liquid droplets of the ink while the first heads 2 (second head 3) are positioned and fixed at the predetermined positions. In the case of the fixed type line head as described above, the influence is increased when the increase in viscosity of the ink in the tubes and/or the contamination with bubbles arises, as compared with the serial type head in which the liquid droplets are jetted while making the reciprocating movement in the printing paper widthwise direction.

That is, unlike the serial type head which is movable in the printing paper widthwise direction, it is impossible for the fixed type line head to complement or supplement the nozzle 55 in which the jetting failure occurs with any other normal nozzle 55, when the jetting failure is partially caused in the nozzle 55, for example, due to the increase in viscosity of the ink in the tube and/or the invasion of air bubbles. Therefore, in order to dissolve the jetting failure of the nozzle 55, the suction purge is performed by the maintenance mechanism 6. However, in general, the number of the nozzles 55 in the fixed type line head is extremely large as compared with the serial type head. Therefore, an extremely large amount of the ink is discharged from the nozzles 55 during the suction purge. Therefore, it is extremely significant for the printer 1 having the fixed type line head to suppress the increase in viscosity of the ink and the contamination with air bubbles by shortening the total length of the tubes, in view of the fact that it is possible to decrease the amount of the ink discharged during the suction purge.

Each of the first heads 2 is the head adapted to the high resolution printing. Each of the first heads 2 is formed with the first nozzles 55*a* which have the small nozzle diameter and which are capable of jetting the minute liquid droplets. On the other hand, each of the second heads 3 is the head adapted to the high speed printing. Each of the second head 3 is formed with the second nozzles 55*b* which have the large nozzle diameter as compared with the first nozzles 55*a*. The second heads 3 jet the liquid droplets having the large volumes as compared with the first heads 2. In this arrangement, the first heads 2 each having the small nozzle diameter jet the small liquid droplets as compared with the second heads 3 each of which has the large nozzle diameter for jetting the large liquid droplets. Therefore, when the viscosity-increased ink and/or the ink containing air bubbles is/are supplied to the first heads 2, the influence of the viscosity-increased ink and the air bubbles is exerted to a large extent to easily cause the jetting failure such as a misjetting in which the liquid droplets are jetted in a wrong direction (non-straight jetting).

On the other hand, when the two heads are arranged in series, the length of the tubes, through which the ink is allowed to pass until arrival at the heads from the ink cartridges 4, is elongated for the heads which are positioned on the more downstream side in the ink supply direction while being separated farther from the ink cartridges 4. Therefore, the viscosity-increased ink and/or the ink containing a large amount of air bubbles is/are supplied to the heads disposed on the downstream side. However, in the case of the printer 1 of this embodiment, the second heads 3, each of which has the large nozzle diameter and which hardly causes the jetting failure, are arranged on the downstream side in the ink supply direction separated farther from the ink cartridges 4. Therefore, the occurrence of the jetting failure is suppressed in the first heads 2 which are susceptible to the viscosity-increased ink and the bubbles. Therefore, it is possible to decrease the number of times of the suction purge performed by the maintenance mechanism 6, and it is possible to decrease the amount of the ink consumed during the purge.

When the jetting failure such as the nozzle clog-up or the non-straight jetting arises in the first heads 2 adapted to the high resolution printing in which the liquid droplets having small volumes are jetted to print the high definition image, the influence exerted on the printing quality is extremely large as compared with the case in which the jetting failure arises in the second nozzles 55*b* adapted to the high speed printing for which the high resolution is not required. Also from this viewpoint, it is preferable that the first heads 2 adapted to the high resolution printing is arranged on the side of the ink cartridges 4 (on the upstream side in the ink supply) on which the ink to be supplied involves a small degree of mixing or contamination with the viscosity-increased ink and/or the air bubbles.

Next, an explanation will be made about modified embodiments in which various modifications are applied to the embodiment described above. However, those constructed in the same manner as those of the embodiment described above are designated by the same reference numerals, any explanation which will be appropriately omitted.

In the embodiment described above, both of the two heads having the different nozzle positions are the fixed type line heads. However, one or both of the two heads may be a serial type head or serial type heads in which the liquid droplets are jetted onto the printing paper while making the reciprocating movement in a predetermined direction. In other words, the printer according to the present invention may be provided with a head holder on which the head is mounted, and a head-driving mechanism which allows the head holder to perform the reciprocating movement in the predetermined direction (main scanning direction, direction perpendicular to the transport direction of the printing paper). Even in this case, the same or equivalent effect is obtained by applying the present invention. A certain nozzle, in which the jetting failure arises, can be complemented or supplemented by controlling the jetting timing of any other nozzle in which no failure arises in relation to the jetting operation and the scanning velocity of the head, when the jetting failure arises in the certain nozzle due to the increase in viscosity of the liquid in the tubes and/or the invasion of air bubbles, because one (or both) of the first and second heads is the so-called serial type head in which the liquid droplets are jetted while making the reciprocating movement in the predetermined scanning direction. The number of nozzles of the serial head can be made relatively small. Therefore, even when the purge is performed to discharge the viscosity-increased liquid and/or the air bubbles from the nozzles in order to dissolve the jetting failure, it is enough to consume a small amount of the liquid discharged from the nozzles during the purge.

In the embodiment described above, the two heads are connected in series to one ink cartridge. That is, the ink cartridge, the first head having smaller diameter nozzles, and the second head having larger diameter nozzles are connected in-line in this order from the upstream side in the ink supply direction, via the tubes. On the other hand, a plurality of (three or more) heads, which may have mutually different nozzle diameters, may be connected in series to one ink cartridge. In this arrangement, the plurality of heads are connected in series (in-line) such that the head having the smaller diameter nozzles is positioned nearer to the ink cartridge (on the upstream side in the ink supply direction).

The sizes of the diameters of the first and second nozzles and the sizes of the liquid droplets jetted from the first and second nozzles are exemplified in the embodiments described above by way of example in every sense. The present invention is not limited thereto. In general, nozzles having several μm to 60 μm diameter are available for the inkjet printer. The relation between the diameter of the nozzle and the volume of the droplet jetted from the nozzle depends on the types of the actuator. In case of the thermal-type actuator, a minute droplet of 1 pl is obtained by using a nozzle of 9 μm diameter. Regarding the piezoelectric actuator, a minute droplet of 1 to 1.5 pl is obtained by using a nozzle of a dozen or more μm to 20 μm. In the embodiments described above, the present invention is applied to the printer of the ink-jet system in which the ink is jetted against the recording paper to record the image or the like. However, the application objective of the present invention is not limited to the printer as described above. That is, the present invention is applicable to various liquid droplet jetting apparatuses for jetting various types of liquids other than the ink onto the objective depending on the way of use. The present invention is also applicable, for example, to an apparatus for forming a wiring pattern by transferring, to a substrate, a conductive liquid dispersed with metal nano particles, an apparatus for producing a DNA chip by using a solution dispersed with DNA, an apparatus for producing a display panel by using a solution dispersed with an EL light emission material such as an organic compound, and an apparatus for producing a color filter for the liquid crystal display by using a liquid dispersed with a pigment for the color filter.

What is claimed is:

1. A liquid droplet jetting apparatus which jets a droplet of a liquid onto an object, the liquid droplet jetting apparatus comprising:

a first head in which first nozzles are formed, the first head including a plurality of layers;

a second head in which second nozzles are formed, each of the second nozzles having a nozzle diameter greater than that of one of the first nozzles, the second head including a plurality of layers;

a liquid tank which stores the liquid to be supplied to the first head and the second head; and a plurality of tubes which connect the layers of the first head, the layers of the second head, and the liquid storage container respectively;

wherein the first head is connected to one end of a first tube of the tubes and the liquid tank is connected to the other end of the first tube; and wherein at least one layer of the second head is connected to at least one layer of the first head by a second tube of the tubes, and the second head is connected to the liquid tank via the at least one layer of the first head.

2. The liquid droplet jetting, apparatus according to claim 1;

wherein the first head is capable of jetting the droplet of the liquid at a volume smaller than that of the, droplet jetted by the second head.

3. The liquid droplet jetting apparatus according to claim 1, further comprising:

a transport mechanism which, transports-the object in a predetermined transport direction, wherein the second head is arranged on an upstream side of the first head in the transport direction.

4. The liquid droplet jetting apparatus according to claim 1;

wherein the liquid tank is connected to one end of the first head; and wherein the second head is connected to the other end of the first head.

5. The liquid droplet jetting apparatus according to claim 1;

wherein each of the first head and the second head is a fixed type line head which has a nozzle array including a plurality of nozzles arranged in a predetermined arranging direction and which jets the droplet of the liquid while, being positioned and fixed at a predetermined position.

6. The liquid droplet jetting apparatus according to claim 1, further comprising:

a purge mechanism which has a first cap covering the first nozzles of the first head; a second cap; covering3 the second nozzles of the second head;

a cap-driving mechanism driving the, first and second caps such that the first cap and the second cap are capable of coming into contact with and separating away from a first nozzle surface of the first head and a second nozzle surface of the second head, respetctively, the first nozzle.being formed in the first nozzle surface and the second nozzles being formed in the second nozzle surface; and a sucking mechanism connected to the first and second caps to evacuate a first space defined by the first cap and the first nozzle surface and a second space defined by the second cap and the second nozzle surface.

7. The liquid droplet jetting apparatus according to claim 6;

wherein the sucking mechanism has a suction pump, and a sitch which switches a connection target of the suction pump between the first space and the second space.

8. The liquid droplet jetting apparatus according to claim 1;

wherein one of the first and second heads is a serial type head which jets the droplet of the liquid onto the object while reciprocating in a predetermined direction.

9. The liquid droplet jetting apparatus according to claim 1;

wherein the liquid is an ink; and each of the first and Second heads is a piezoelectric type ink-jet head which lets a dropletof the ink, onto the object.

* * * * *